US007178576B2

(12) United States Patent
Nien et al.

(10) Patent No.: US 7,178,576 B2
(45) Date of Patent: Feb. 20, 2007

(54) CORD MEMBER CONTROL DEVICE FOR VENETIAN BLIND

(75) Inventors: Ming Nien, Changua Hsien (TW); D. C. Chen, Lugang Township, Changhua County (TW); Julio Liu, Las Condes (CL)

(73) Assignee: Nien Made Enterprise Co., Ltd., Taichung (TW)

( * ) Notice: Subject to any disclaimer, the term of this patent is extended or adjusted under 35 U.S.C. 154(b) by 264 days.

(21) Appl. No.: 10/896,977

(22) Filed: Jul. 23, 2004

(65) Prior Publication Data

US 2005/0087310 A1 Apr. 28, 2005

(30) Foreign Application Priority Data

Oct. 27, 2003 (TW) ..... 92219071 U

(51) Int. Cl.
*E06B 9/30* (2006.01)

(52) U.S. Cl. ..... 160/168.1 R; 160/178.1 R; 160/173 R

(58) Field of Classification Search ..... 160/168.1 R, 160/170, 171, 173 R, 178.1 R, 177 R, 178.3
See application file for complete search history.

(56) References Cited

U.S. PATENT DOCUMENTS

| | | | | |
|---|---|---|---|---|
| 5,309,974 | A * | 5/1994 | Fraser | 160/176.1 R |
| 5,692,552 | A * | 12/1997 | Judkins | 160/168.1 R |
| 6,530,415 | B2 * | 3/2003 | Wu | 160/168.1 R |
| 6,792,997 | B2 * | 9/2004 | Damiano | 160/178.1 R |
| 2004/0188038 | A1 * | 9/2004 | Nien | 160/168.1 R |

* cited by examiner

*Primary Examiner*—Blair M. Johnson
(74) *Attorney, Agent, or Firm*—Birch, Stewart, Kolasch & Birch, LLP

(57) ABSTRACT

A cord member control device is mounted in a bottom rail of a Venetian blind to support a lift cord and a ladder tape of the Venetian blind. The cord member control device includes a pulley assembly holding a pair of wheels over which the lift cord passes, and a locating member extended from the pulley assembly and fastened to a mounting hole of the bottom rail to secure the pulley assembly to the bottom rail. The locating member has a recessed open chamber and a transverse through hole, which extends across the recessed open chamber for the passing of front and rear tapes of the ladder tape for enabling the front and rear tapes of the ladder tape to be fastened together in the recessed open chamber with a clip.

12 Claims, 7 Drawing Sheets

CORD MEMBER CONTROL DEVICE FOR VENETIAN BLIND

This Nonprovisional application claims priority under 35 U.S.C. § 119(a) on Patent Application No(s). 092219071 filed in Taiwan, Republic of China on Oct. 27, 2003, the entire contents of which are hereby incorporated by reference.

BACKGROUND OF THE INVENTION

1. Field of the Invention

The present invention relates to a Venetian blind and more specifically to a cord member control device for use in the bottom rail of a Venetian blind to support a corresponding lift cord and a corresponding ladder tape.

2. Description of the Related Art

FIG. 12 shows a conventional Venetian blind 90, which comprises a headrail 91, a plurality of slats 92, a bottom rail 93, two ladders 94, and two lift cords 95. The headrail 91 is transversely fixedly mounted in the top side of the window. The slats 92 are arranged in parallel below the headrail 91, each having two through holes 96 near the two distal ends. The ladder tapes 94 join the slats 92 between the headrail 91 and the bottom rail 93, each comprised of a front tape 941, a rear tape 942 and a plurality of retaining straps connected between the front tape 941 and rear tape 942 at different elevations to hold the slats 92 in parallel between the headrail 91 and the bottom rail 93. The front tape 941 and the rear tape 942 of the ladder type 94 are fastened to the bottom side of the bottom rail 93 with a plug member 97, which supports a guide roller 98 inside the bottom rail 93. Each lift cord 95 has one end fixedly fastened to the headrail 91, and the other end downwardly inserted through one through hole 96 of each slat 92 and moved over the guide roller 98 at the corresponding plug member 97 and then upwardly inserted through the same through hole 96 in each slat 97 to the headrail 91 and then extended out of one end of the headrail 91 for operation by the user to lift and lower the bottom rail 93. The guide roller 98 enables the user to operate the lift cord 95 with less effort.

This design of the above-mentioned Venetian blind 90 is functional. However, it is inconvenient to adjust the vertical length of the Venetian blind 90 in order to fit a relatively smaller window. When adjusting the vertical length of the Venetian blind 90, the user must remove the unnecessary slats 92 and cut off the unnecessary part of the ladder tapes 94, and then remove the plug members 97 and the waste parts of the ladder tapes from the bottom rail 93, and then fasten the plug members 97 to the bottom rail 93 to secure the front tapes 941 and rear tapes 942 of the ladder tapes 94 to the bottom rail 93. The guide roller 98 at each plug member 97 enables the user to pull the respective lift cord 95 with less effort; however, this design is still not satisfactory in function. Further, because each slat 92 must have through holes 96 for the passing of the lift cords 95, incident light may pass through the through holes 96 into the inside of the house when the user tilted the slats 92 to the close position.

SUMMARY OF THE INVENTION

It is the primary objective of the present invention to provide a cord member control device for use in a Venetian blind, which allows the user to adjust the length of the ladder tape conveniently.

It is another objective of the present invention to provide a cord member control device for use in a Venetian blind, which enables the user to operate the lift cord with less effort.

It is still another objective of the present invention to provide a cord member control device for use in a Venetian blind, which improves the light shading effect of the blind.

To achieve these objectives, the cord member control device provided by the present invention is used in a Venetian blind. The Venetian blind comprises at least two lift cords, at least two ladder tapes each having a front tape and a rear tape, and a bottom rail having a plurality of mounting holes corresponding to the lift cords and the ladder tapes. The cord member control device comprises a pulley assembly mounted in the bottom rail, and a locating member for securing the pulley assembly to the bottom rail. The pulley assembly holds at least one wheel over which the lift cord passes. The locating member has a first end fixedly connected to the pulley assembly, a second end inserted through a mounting hole of the bottom rail and extended to outside of the bottom rail, a recessed open chamber formed in the second end, and a transverse through hole extended across the recessed open chamber for the passing of the front tape and rear tape of the ladder tape for enabling the front tape and rear tape to be fastened together in the recessed open chamber.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
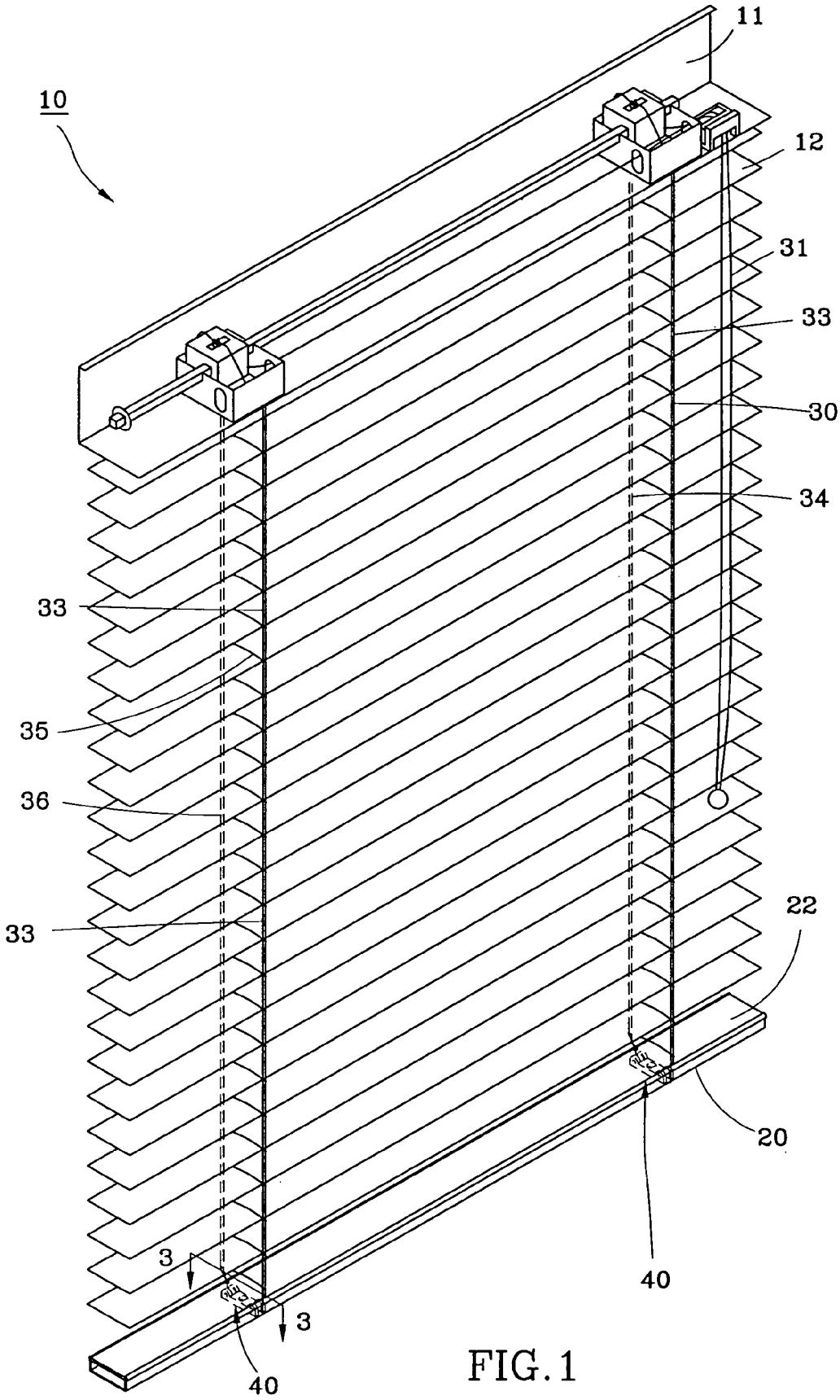
FIG. 1 is a perspective view of a Venetian blind constructed according to a first preferred embodiment of the present invention.
Figure 2:
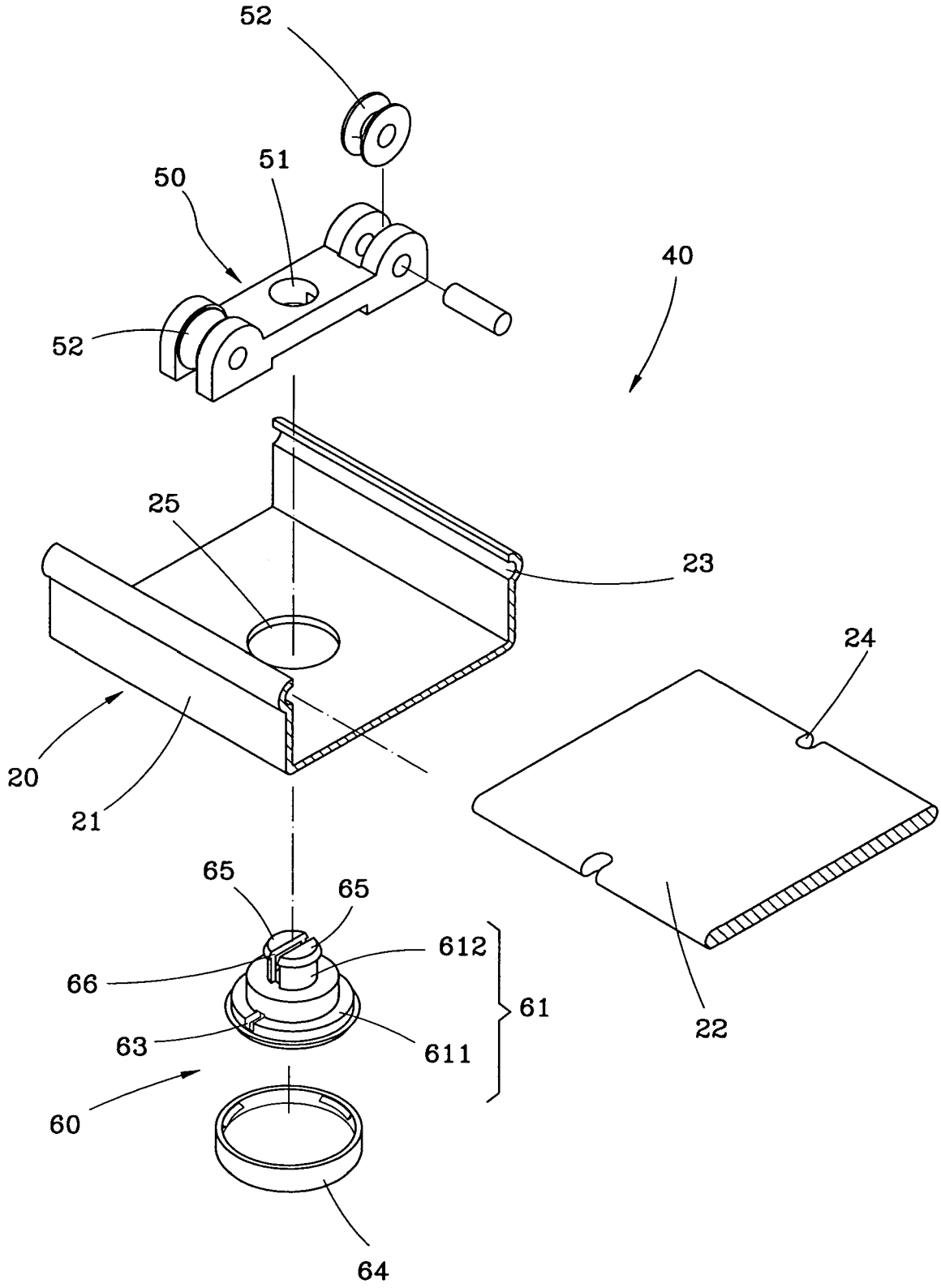
FIG. 2 is an exploded view of a cord member control device according to the first preferred embodiment of the present invention.
Figure 3:
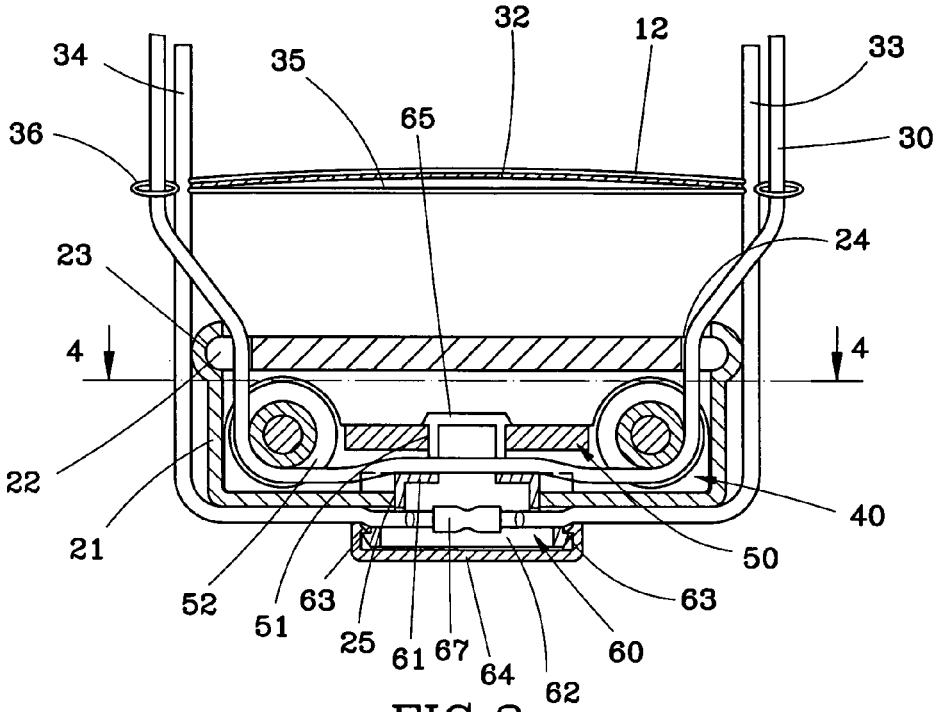
FIG. 3 is a sectional view taken along the line 3—3 of FIG. 1.
Figure 4:
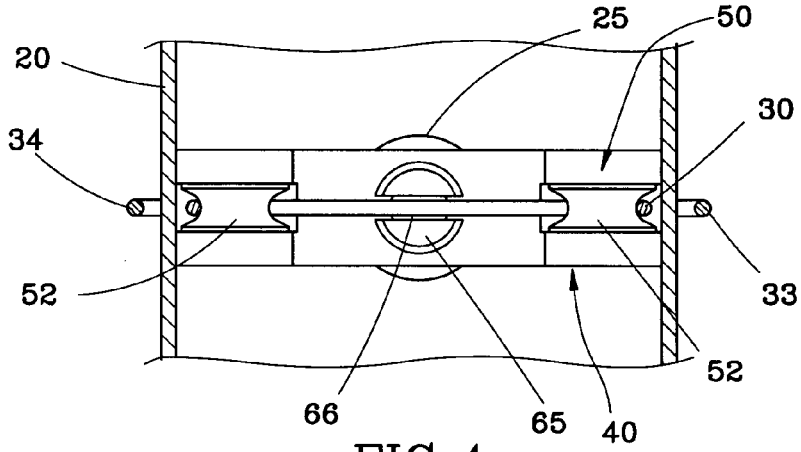
FIG. 4 is a sectional view taken along line 4—4 of FIG. 3.
Figure 5:
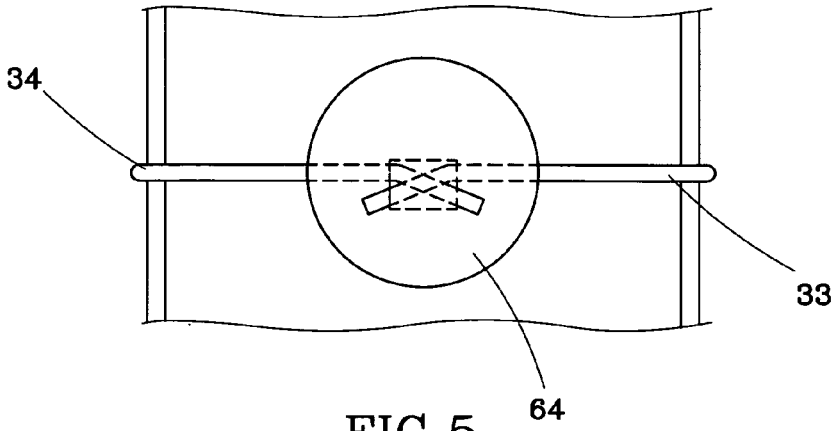
FIG. 5 is a top view of the first preferred embodiment of the present invention.
Figure 6:
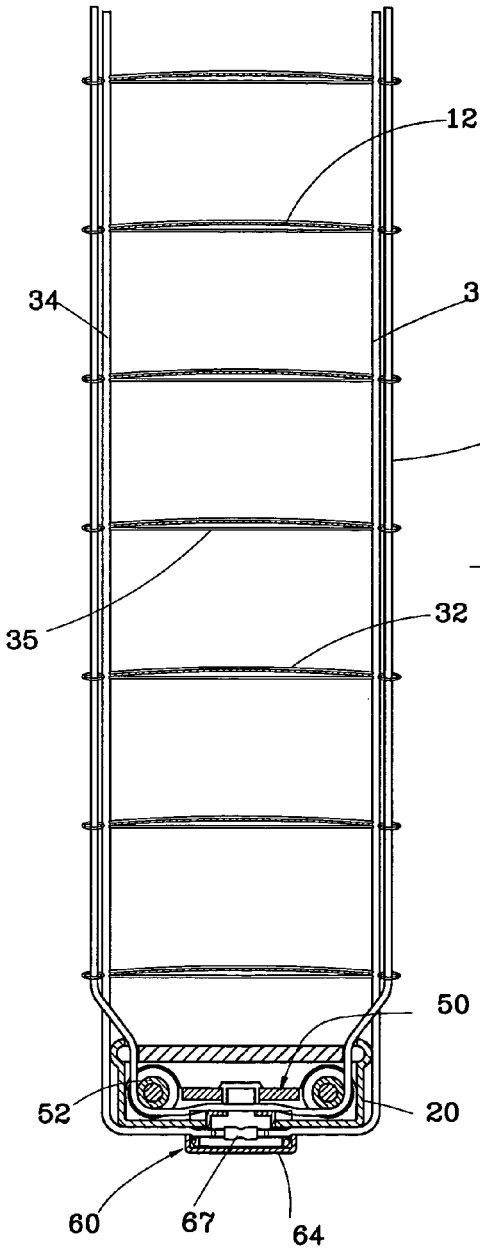
FIGS. 6–10 are schematic drawings showing the adjustment procedure of the vertical length of the Venetian blind according to the present invention.
Figure 7:
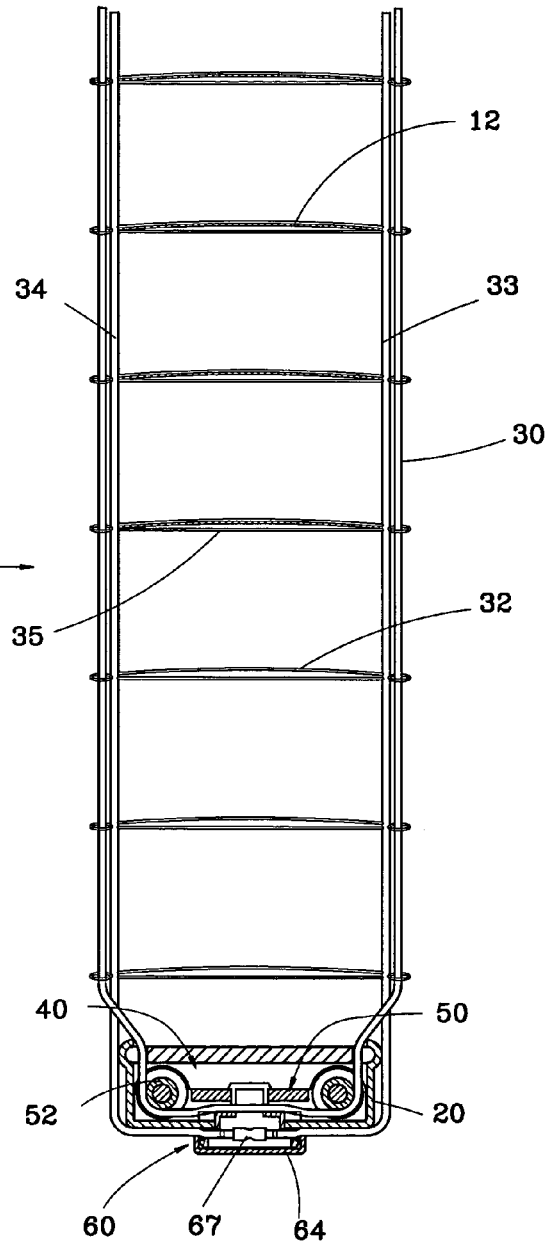
Figure 8:
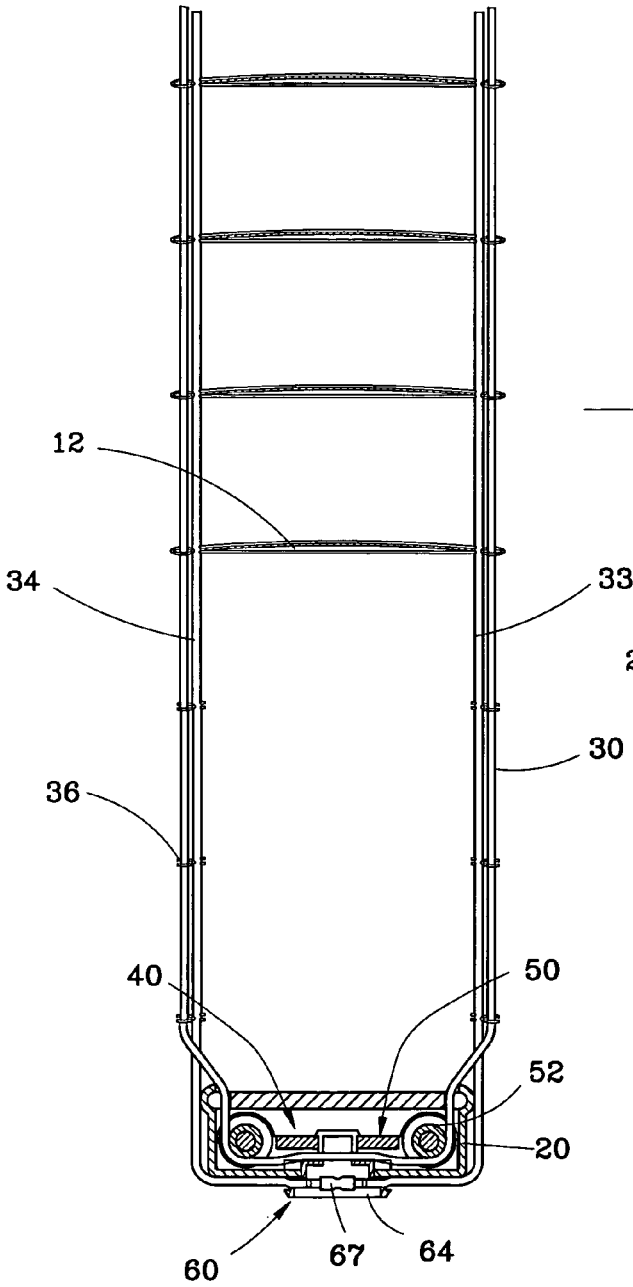
Figure 9:
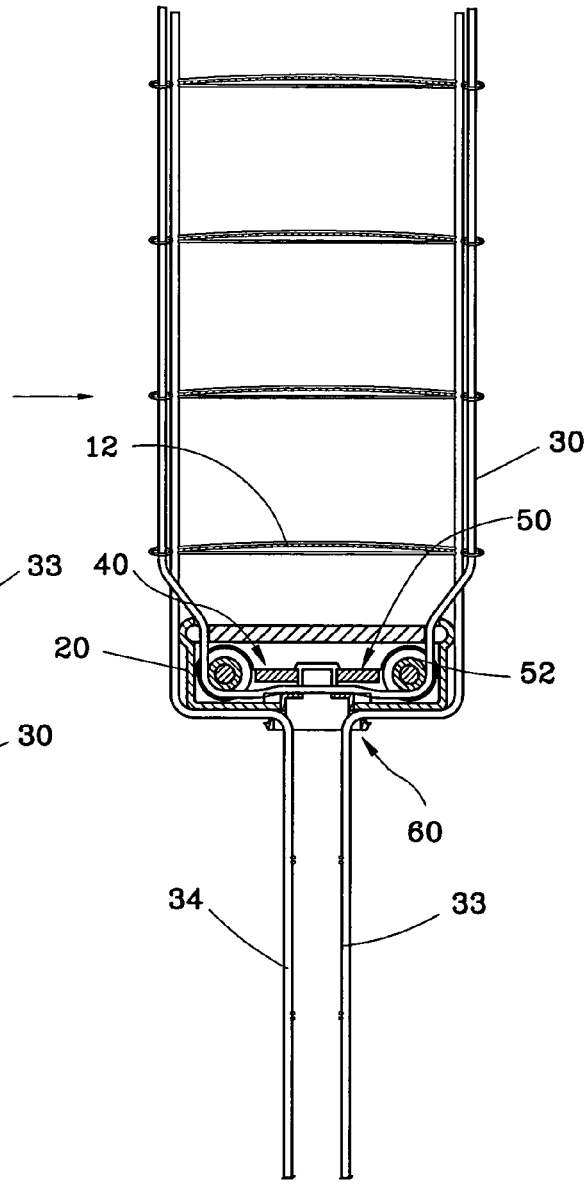
Figure 10:
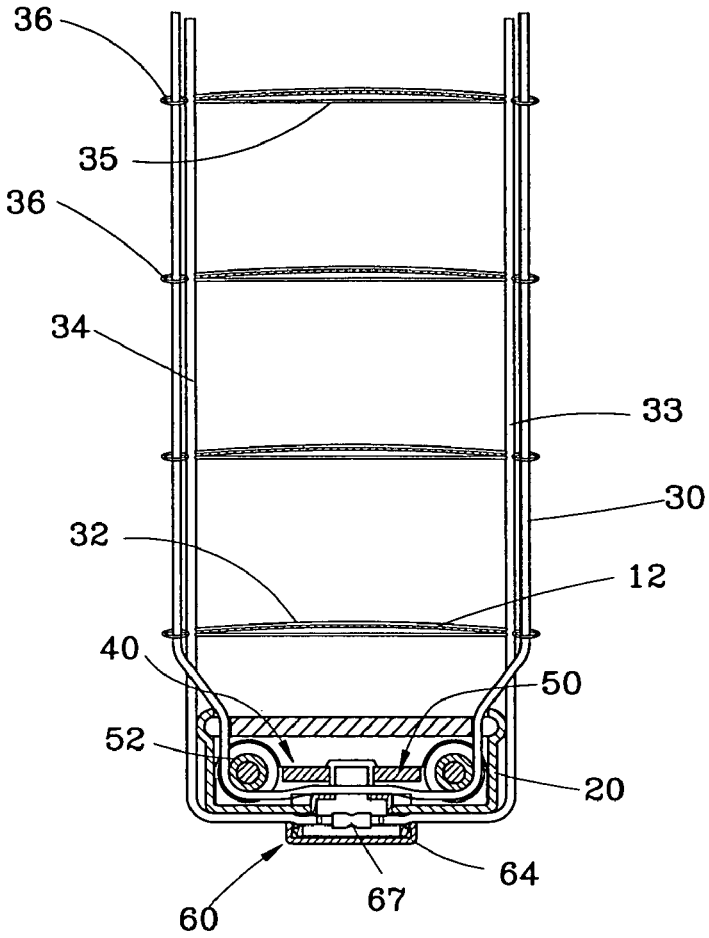

Referring to FIGS. 1–5, a Venetian blind is shown comprised of a headrail 11, a plurality of slats 12, a bottom rail 20, two lift cords 30, two ladder tapes 32, and two cord member control devices 40.

The headrail 11 is to be transversely fixedly mounted on the top side of the window (not shown).

The slats 12 are transversely arranged in parallel below the headrail 11.

The bottom rail 20 is an elongated box member transversely provided below the slats 12, comprising an elongated casing 21, which has a U-shaped cross section, and a cover plate 22 covering the casing 21. The casing 21 comprises two coupling grooves 23 respectively extended along the two opposite long sides, and two mounting holes 25 formed in the bottom wall near the two distal ends. The cover plate 22 is inserted into the coupling grooves 23, having two pairs of wire holes 24 symmetrically disposed at the front and rear sides near the two distal ends corresponding to the mounting holes 25.

The lift cords 30 have the respective first end fastened to the headrail 11, and the respective second end moved over the rear side of the slats 12 and respectively downwardly inserted through the two wire holes 24 at the rear side of the cover plate 22 and then upwardly inserted through the other two wire holes 24 at the front side of the cover plate 22 and moved over the front side of the slats 12 and then transversely extended through the inside of the headrail 11 and then fastened to each other to form a combined cord member 31 that is suspended outside the headrail 11 for operation by the user to lift and lower the slats 12.

The two ladder tapes 32 are fastened to the headrail 11 near the two distal ends corresponding to the lift cords 30, each formed of a front tape 33 and a rear tape 34. The front tapes 33 and rear tapes 34 of the two ladder tapes 32 are vertically disposed at the front and rear sides of the slats 12. The ladder tapes 32 each further comprise pairs of retaining straps 35 connected between the respective front tapes 33 and rear tapes 34 at different elevations to hold the slats 12 in parallel between the headrail 11 and the bottom rail 20. Further, the front tapes 33 are respectively connected to the rear tapes 34 below the mounting holes 25 of the bottom rail 20. The front tapes 33 and rear tapes 34 of the ladder tapes 32 each having a plurality of vertically spaced eyelets 36 for the passing of the lift cords 30 (because the structure and arrangement of the lift cords 30 and the ladder tapes 32 are of the known art and not within the scope of the claims of the present invention, no further detailed description in this regard is necessary).

The two cord member control devices 40 (see FIG. 2) are mounted in the bottom rail 20 corresponding to the mounting holes 25, each comprised of a pulley assembly 50 and a locating member 60.

The pulley assembly 50 is an elongated block member holding a pair of wheels 52 at two ends, having a round hole 51 extended through the top and bottom sides in vertical alignment with one mounting hole 25 of the bottom rail 20.

The locating member 60 is comprised of a locating bolt 61 and an annular covering 64. The locating bolt 61 comprises a stepped head 611, a flanged split shank 612 perpendicularly extended from the stepped head 611, a recessed open chamber 62 formed in the stepped head 611 and axially forwardly extended toward the inside of the flanged split shank 612, and a transverse through hole 63 transversely extended through the stepped head 611 across the recessed open chamber 62. The annular covering 64 is capped on the stepped head 611 to cover the recessed open chamber 62. The flanged split shank 612 comprises two flanged shank elements 65, and a longitudinal locating slot 66 separating the flanged shank elements 65 (the contour of the flange of the flanged split shank 612 is lightly greater than the diameter of the round hole 51 of the pulley assembly 50). During installation, the flanged shank elements 65 of the flanged split shank 612 are radially squeezed toward each other and then inserted vertically upwardly through one mounting hole 25 of the casing 21 of the bottom rail 20 and the round hole 51 of the respective pulley assembly 50 to secure the respective pulley assembly 50 to the bottom rail 20. When released the hand from the locating bolt 61, the flanged shank elements 65 are respectively hooked on the top wall of the respective pulley assembly 50 around the round hole 51. After having been inserted through one wire hole 24 at the rear side of the cover plate 22, the second end of the lift cord 30 is moved over the wheels 52 of the respective pulley assembly 50 across the longitudinal locating slot 66, and then upwardly inserted through the corresponding wire hole 24 at the front side of the cover plate 22 and then extended vertically upwardly over the front side of the slats 12 to the headrail 11. The front tape 33 and rear tape 34 of each ladder tape 32 are respectively inserted into the transverse through hole 63 of the locating bolt 61 of the respective locating member 60 and then fastened in the recessed open chamber 62 of the locating bolt 61 by a clip 67. After installation, the annular covering 64 is capped on the locating bolt 61 of the respective locating member 60.

The operation of the present invention will now be described hereinafter with reference to FIGS. 6–11. If it is necessary to shorten the vertical length of the Venetian blind 10 in order to fit the window, remove the unnecessary slats 12 (see FIGS. 5. 6 and 7), cut off the unnecessary retaining straps 35 and eyelets 36 (see FIG. 8), and then remove the annular covering 64 from the locating bolt 61 and lift the bottom rail 20 to the desired elevation and remove the clips 67 from the respective ladder tapes 32, and then pull and cut the front tapes 33 and the rear tapes 34 subject to the desired length (see FIG. 9), and then fasten the front tapes 33 to the rear tapes 34 with the respective clips 67 and cap the annular coverings 64 onto the respective locating bolts 61 (see FIG. 10). Thus, the adjustment of the vertical length of the Venetian blind 10 is done.

Because the lift cords 30 are moved over the wheels 52 of the respective pulley assemblies 50, the weight of the Venetian blind is evenly shared out to the headrail 11 and the user's hand and, the user can operate the combined cord member 31 to lift and lower the bottom rail 20 smoothly with less effort.

Further, because the lift cords 30 are moved downwards over the rear side of the slats 12 to the bottom rail 20 and moved upwards over the front side of the slats 12 to the headrail 11, it is not necessary to make holes in the slats 12, and the Venetian blind provides a better light shading effect when tilted the slats 12 to vertical.

Because each lift cord 30 is moved over the locating slot 66 of the respective pulley assembly 50, the locating slot prohibits the respective lift cord 30 from biasing when the user operating the combined cord member 31.

Figure 11:
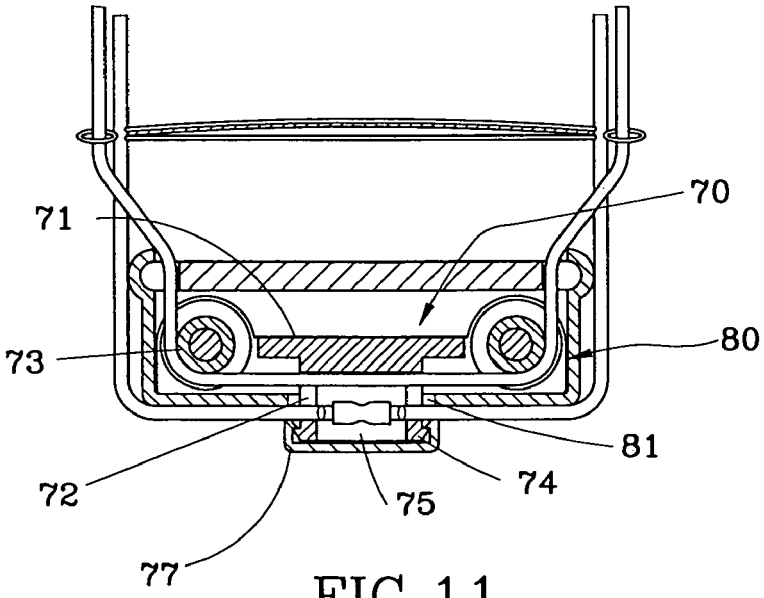
FIG. 11 is a sectional view of a second preferred embodiment of the present invention.
Figure 12:
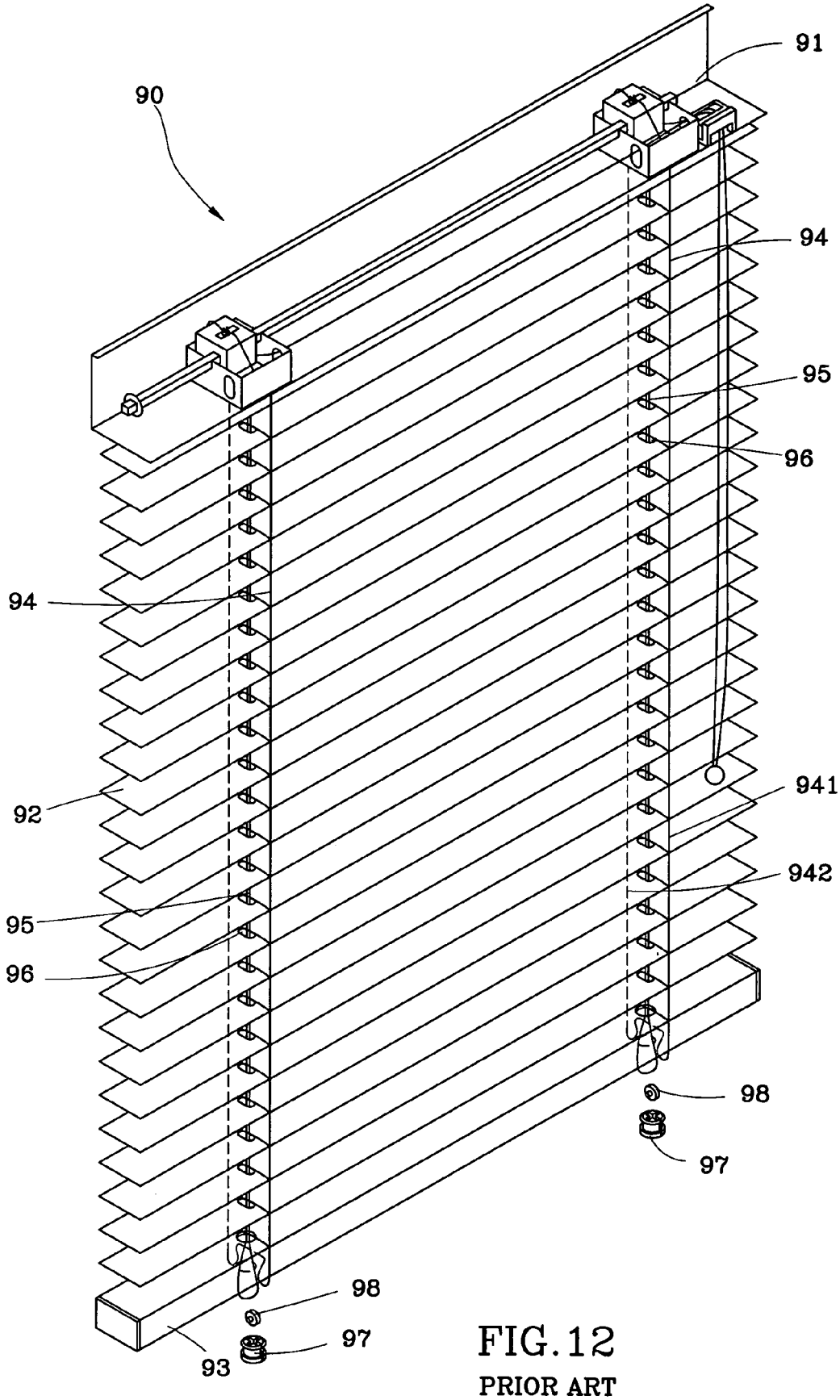
FIG. 12 PRIOR ART
FIG. 12 is a perspective exploded view of a Venetian blind constructed according to the prior art.

In the aforesaid first embodiment of the present invention, each cord member control device 40 is comprised of a pulley assembly 50 and a locating member 60. As an alternate form of the present invention, the locating member can be formed integral with the pulley assembly. In FIG. 11, the cord member control device. 70 which is installed in the bottom rail 80 of a Venetian blind comprises a pulley assembly 71 holding a pair of wheels 73, a flanged split locating bolt 74 formed integral with and downwardly perpendicularly extended from the bottom wall and fastened to the bottom wall of the bottom rail 80, and a covering 77 detachably capped on the flanged split locating bolt 74. The flanged split locating bolt 74 has a recessed open chamber 75 in which the front tape and rear tape of the respective lift cord are fastened together with a clip in the same way as the aforesaid first preferred embodiment of the present invention. Further, the flanged split locating bolt 74 has a locating slot 72 for the passing of the respective lift cord.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A cord member control device for a Venetian blind that comprises at least two lift cords, at least two ladder tapes each having a front tape and a rear tape, and a bottom rail having a plurality of mounting holes corresponding to said lift cords and said ladder tapes, said cord member control device comprising:

a pulley assembly mounted in said bottom rail, said pulley assembly holding at least one wheel over which said lift cord passes; and a locating member having a first end connected to said pulley assembly, a second end inserted through the mounting hole of said bottom rail and extended to outside of said bottom rail, a recessed open chamber formed in said second end, and a transverse through hole extended across said recessed open chamber for the passing of the front tape and rear tape of said ladder tape for enabling the front tape and rear tape to be fastened together in said recessed open chamber, wherein the locating member comprises a locating slot for the passing of the lift cord.

2. The cord member control device as claimed in claim 1, wherein said pulley assembly comprises a round hole extended through top and bottom sides thereof in axial alignment with one of the mounting holes of said bottom rail; said locating member comprises a locating bolt having said recessed open chamber and said transverse through hole at an end thereof, and two flanged springy shank elements between which a longitudinal locating slot for the passing of one said lift cord is formed at the other end thereof, said two flanged springy shank elements being inserted through one of the mounting holes of said bottom rail and hooked in the round hole of said pulley assembly such that the transverse through hole is located outside said bottom rail.

3. The cord member control device as claimed in claim 1, wherein said pulley assembly holds two wheels, which are respectively pivotally mounted in two distal ends of said pulley assembly.

4. The cord member control device as claimed in claim 1, further comprising a covering covered on the second end of said locating member.

5. The cord member control device as claimed in claim 1, wherein said bottom rail of said window blind comprises a plurality of holes symmetrically formed in front and rear sides thereof for the passing of said lift cords.

6. A cord member control device for a Venetian blind that comprises at least two lift cords, at least two ladder tapes each having a front tape and a rear tape, and a bottom rail having a plurality of mounting holes corresponding to said lift cords and said ladder tapes, said cord member control device comprising:

a pulley assembly mounted in said bottom rail, said pulley assembly holding at least one wheel over which said lift cord passes; and a locating member having a first end connected to said pulley assembly, a second end inserted through the mounting hole of said bottom rail and extended to outside of said bottom rail, a recessed open chamber formed in said second end, and a transverse through hole extended across said recessed open chamber for the passing of the front tape and rear tape of said ladder tape for enabling the front tape and rear tape to be fastened together in said recessed open chamber, wherein the first end of said locating member is integrally connected to a bottom of said pulley assembly, and said pulley assembly holds two wheels, which are respectively pivotally mounted in two distal ends of said pulley assembly.

7. The cord member control device as claimed in claim 6, wherein said pulley assembly comprises a locating slot for the passing of said lift cord.

8. A cord member control device for a Venetian blind that comprises at least two lift cords, at least two ladder tapes each having a front tape and a rear tape, and a bottom rail having a plurality of mounting holes corresponding to said lift cords and said ladder tapes, said cord member control device comprising:

a pulley assembly mounted in said bottom rail, said pulley assembly holding at least one wheel over which said lift cord passes; and a locating member having a first end connected to said pulley assembly, a second end inserted through the mounting hole of said bottom rail end extended to outside of said bottom rail, a recessed open chamber formed in said second end, and a transverse through hole extended across said recessed open chamber for the passing of the front tape and rear tape of said ladder tape for enabling the front tape and rear tape to be fastened together in said recessed open chamber, wherein said pulley assembly holds two wheels, which are respectively pivotally mounted in two distal ends of said pulley assembly.

9. The cord member control device as claimed in claim 8, wherein said locating member comprises a locating slot for the passing of the lift cord.

10. The cord member control device as claimed in claim 8, wherein said pulley assembly comprises a round hole extended through top and bottom sides thereof in axial alignment with one of the mounting holes of said bottom rail; said locating member comprises a locating bolt having said recessed open chamber and said transverse through hole at an end thereof, and two flanged springy shank elements between which a longitudinal locating slot for the passing of one said lift cord is formed at the other end thereof, said two flanged springy shank elements being inserted through one of the mounting holes of said bottom rail and hooked in the round hole of said pulley assembly such that the transverse through hole is located outside said bottom rail.

11. The cord member control device as claimed in claim 8, further comprising a covering covered on the second end of said locating member.

12. The cord member control device as claimed in claim 8, wherein said bottom rail of said window blind comprises a plurality of holes symmetrically formed in front and rear sides thereof for the passing of said lift cords.

* * * * *